United States Patent [19]

Satoshi

[11] 4,045,312

[45] Aug. 30, 1977

[54] METHOD FOR THE ELECTROLYTIC ETCHING OF METAL WORKPIECE

[75] Inventor: Takeuchi Satoshi, Kawasaki, Japan

[73] Assignee: Dai Nippon Printing Co., Ltd., Tokyo, Japan

[21] Appl. No.: 635,324

[22] Filed: Nov. 26, 1975

[30] Foreign Application Priority Data

Nov. 30, 1974 Japan ..... 49-138617

[51] Int. Cl.[2] ..... C25F 3/14; C25F 3/00

[52] U.S. Cl. ..... 204/129.65; 204/129.6

[58] Field of Search ..... 204/129.6, 129.65

[56] References Cited

U.S. PATENT DOCUMENTS

| | | | |
|---|---|---|---|
| 2,532,907 | 12/1950 | Hangosky | 204/129.6 |
| 2,620,296 | 12/1952 | Wilsdon | 204/129.65 |
| 2,895,814 | 7/1959 | Clark | 204/129.6 |
| 3,756,937 | 9/1973 | Lucas et al. | 204/129.65 |

FOREIGN PATENT DOCUMENTS

| | | | |
|---|---|---|---|
| 872,961 | 7/1961 | United Kingdom | 204/129.65 |
| 1,009,518 | 11/1965 | United Kingdom | 204/129.65 |

*Primary Examiner*—T. M. Tufariello

*Attorney, Agent, or Firm*—Birch, Stewart, Kolasch & Birch

[57] ABSTRACT

A method for the electrolytic etching of metal workpiece comprising placing a stencil made of an electric insulating material having a pattern consisting of open portions and non-opened portions into intimate contact with the metal workpiece, placing an electrode adjacent to said metal, jetting an electrolyte between said metal workpiece and the electrode while passing an electric current through the jet of electrolyte in a direction from said metal workpiece to said electrode to electrolytically etch said metal workpiece, and then separating said stencil from the electrolytically etched metal workpiece. Said stencil can then be placed into intimate contact with the next metal workpiece to be electrolytically etched, and electrolytically etching the metal workpiece in the same manner as above and then repeating this electrolytic etching procedure with said one stencil thereby etching many metal workpieces.

16 Claims, 20 Drawing Figures

METHOD FOR THE ELECTROLYTIC ETCHING OF METAL WORKPIECE

BACKGROUND AND SUMMARY OF THE INVENTION

The present invention relates to a method for the electrolytic etching of a metal workpiece and more particularly to a method for the electrolytic etching of a metal workpiece wherein a stencil of an electric insulating material is applied on a metal workpiece and the metal workpiece with the stencil is set as an anode opposite to a cathode and a jet of electrolyte is introduced between the cathode and the metal workpiece so that the metal workpiece is electrolytically etched and then the above mentioned steps are repeated using the same stencil, until many metal workpieces are etched.

Electrochemical method and chemical methods are already known among methods for etching a metal workpiece.

The following three methods are enumerated as the method for the electrochemical etching of a metal workpiece.

1. A method wherein a metal workpiece provided with an electric insulating resist pattern on the surface is set in an electrolyte opposite to the cathode of an insoluble metal so that only the bare part of the above mentioned metal workpiece may be electrolytically etched;

2. A so-called electrochemical machining method wherein a tool electrode is placed approaching a metal workpiece as an anode while an electrolyte is jetted on the metal workpiece from a jet of the tool electrode, and during the etching process the tool electrode is gradually traveled toward the metal workpiece while the distance there between is kept constant so that the metal workpiece is electrolytically machined in the configuration following exactly the configuration of the electrode; and 3. A method known as an electrolytic marking method wherein a stencil is wet with an electrolyte and is then applied on a metal workpiece, and a cathode is placed into contact with said stencil and an electric current is passed through the electrolyte in the direction from the metal workpiece to the cathode so that the metal workpiece is electrolytically etched to a minute depth.

As the first method for etching a metal by using a resist, there is practiced a method wherein a resist pattern is formed by printing a resist ink on a metal workpiece and subsequent drying or a method wherein a resist pattern is formed by painting a photoresist on a metal workpiece, with drying, exposing the photoresist through a master plate, developing the photoresist, and drying.

In the electrolytic etching by forming a pattern of a resist, there is required an operation consisting of nine steps of (1) a pretreatment of the metal workpiece, (2) drying, (3) printing of resist ink, (4) drying, (5) electrolytic etching, (6) water washing, (7) resist removal, (8) washing and (9) drying.

Also, in the electrolytic etching by forming a pattern of a photoresist, there is required an operation consisting of 13 steps of (1) a pretreatment of the metal workpiece (2) drying, (3) photoresist painting, (4) drying, (5) exposing through a master pattern, (6) developing, (7) drying, (8) baking, (9) electrolytic etching, (10) water washing, (11) photoresist removal, (12) washing and (13) drying.

Thus, in such methods for the etching of a metal workpiece by using a resist, it is necessary to form a resist ink or photoresist for each etching of a metal workpiece and, in addition, there are many operation steps which are complicated and increase cost.

Also, in the second electrochemical machining method, there exists the problems that the tool electrode is costly and the complicated form is difficult to work.

In the third electrolytic marking method, the electrolyte is consumed instantaneously, the sludge accumulates and therefore the etching can not be deeply performed.

Further, as the latter chemical etching method, there is known a chemical milling method wherein a pattern called a masking plate which is made of a soft and anticorrosive material such as a rubber, is used, and a metal workpiece is clamped between said pattern and an anticorrosive base plate in order that the non-etched part is protected.

In this method, many metal workpieces can be repeatedly etched with one masking plate and therefore there is an advantage that a metal workpiece can be efficiently etched at a low cost. On the other hand, there are defects in that this method has limited application to a simple-shaped product, and can not be applied to a complicated-shaped product or to a product having an isolated pattern in the form of an island, and can not be applied to a product having a large area and where machining tolerance is very low.

An object of the present invention is to provide a method for the electrolytic etching of a metal workpiece wherein there are no defects of conventional metal etching methods and etched products having a close tolerance can be simply and quickly produced at a low cost in a comparatively few operating steps.

Another object of the present invention is to provide a method for the electrolytic etching of metal workpiece wherein a metal workpiece of a large area can be accurately etched.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention is directed to a method for the electrolytic etching of a metal workpiece comprising placing a stencil made of an electric insulating material having a pattern consisting of opening parts and non-opening parts into intimate contact with a metal workpiece, opposing an electrode to said metal workpiece, jetting an electrolyte between said metal workpiece and electrode while passing an electric current through the jet of electrolyte in the direction of from the metal workpiece to the electrode to electrolytically etch said metal workpiece, then separating said stencil from the electrolytically etched metal workpiece, placing it into intimate contact with the next metal to be electrolytically etched, electrolytically etching the metal workpiece in the same manner as is mentioned above and then repeating the latter electrolytic etching with said one stencil thereby etching many metal workpieces.

According to the method of the present invention, as the above mentioned as many workpieces are etched with one stencil and without making of a resist pattern per a workpiece, the operation is simple and not only many complicated-shaped products of close tolerance can be quickly produced at a low cost but also the same etching can be applied even to a metal workpiece having a large area.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

FIG. 9 is a perspective view showing the electrolyte jetting nozzle arranged so as to make the electrolyte flow down along the surface of the electrode plate;

FIG. 10 is a perspective view showing a pair of electrolyte jetting nozzles are arranged so that the direction of the jet flow may be vertical to the metal on both sides of the electrode plate;

FIG. 11 is a perspective view in case two electrode plates arranged in parallel with each other and the electrolyte jetting nozzle is arranged so that the direction of the jet flow may be vertical to the metal workpiece between both electrode plates;

DESCRIPTION OF THE PREFERRED EMBODIMENTS

Figure 1:
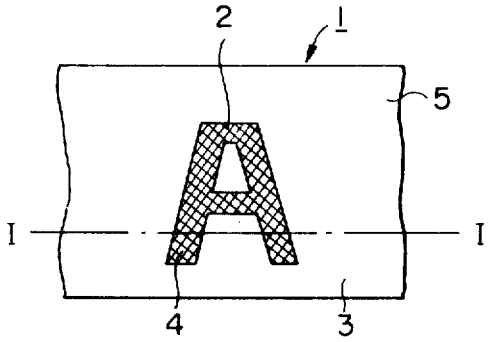
FIG. 1 is a plan view of a stencil.
Figure 2:
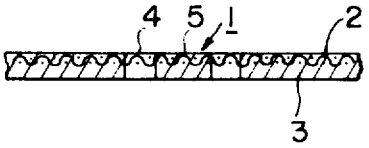
FIG. 2 is a sectional view taken along line I — I in FIG. 1.

FIGS. 1 and 2 show the most preferable embodiment of a stencil used in the electrolytic etching system of the present invention.

A stencil 1 consists of an electric insulating resist 3 (which is called a resist pattern hereinafter) forming a pattern consisting of an open section 4 a non-open section 5 and an electric insulating screen 2. The resist pattern 3 is supported by the electric insulating screen 2.

Figure 3:
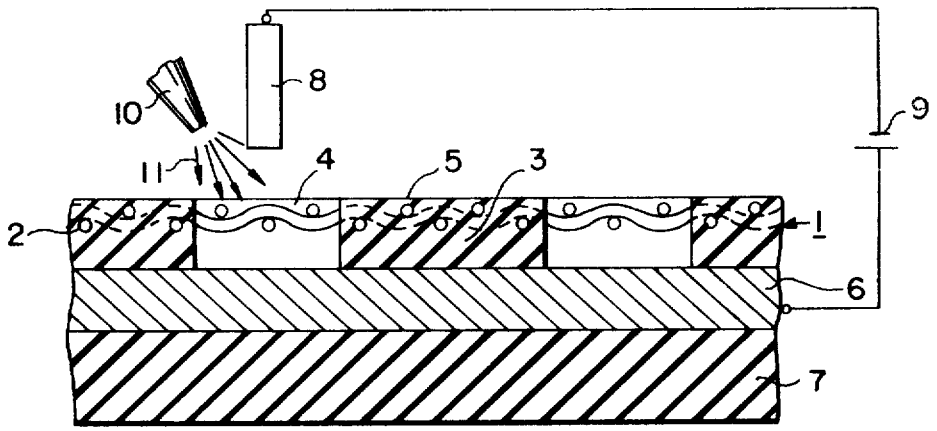
FIG. 3 is an enlarged sectional view showing the stencil shown in FIG. 2 as placed into intimate contact with a metal workpiece to be electrolytically etched.
Figure 4:
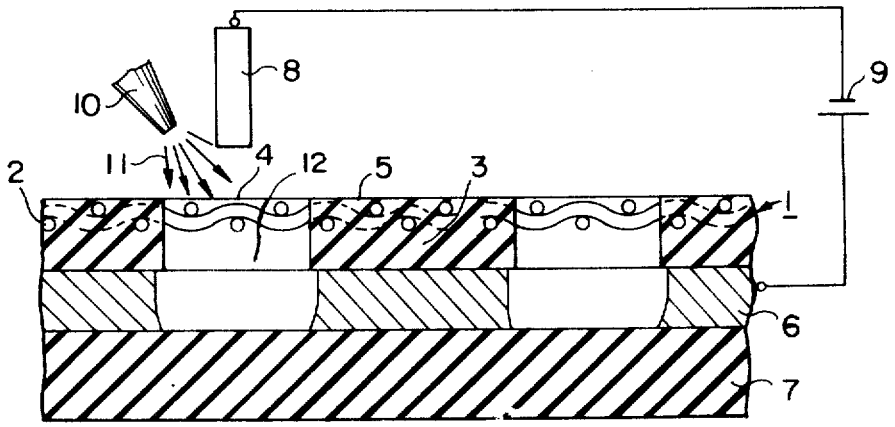
FIG. 4 is an enlarged sectional view showing the stencil shown in FIG. 2 as remaining in intimate contact with the electrolytically etched metal.
Figure 5:
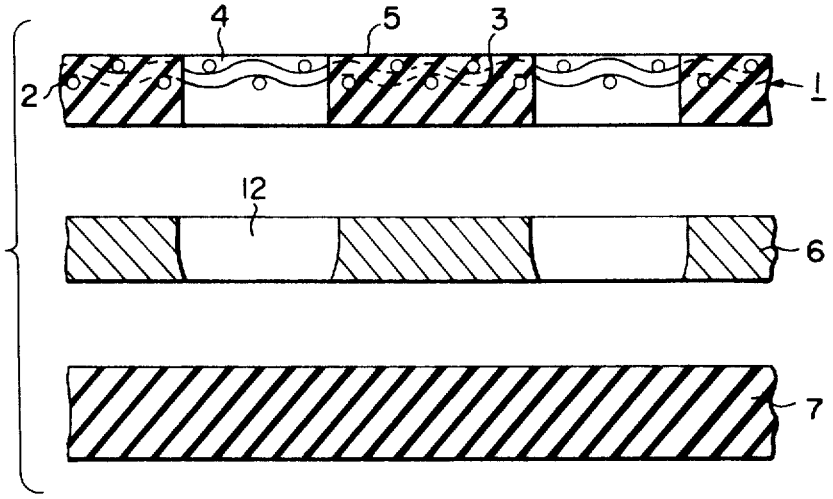
FIG. 5 is an enlarged sectional view showing the stencil, metal workpiece and metal workpiece supporting base as separated after the electrolytic etching.

FIGS. 3, 4 and 5 represent electrolytic etching steps according to the electrolytic etching method of the present invention.

As shown in FIG. 3, a stencil 1 is placed into intimate contact with a metal workpiece 6 mounted on a supporting base 7, an electrode 8 is arranged to oppose the metal workpiece 6. A jet of electrolyte 11 is jetted from a nozzle 10 on the metal workpiece 6 so as to flow between the above mentioned electrode 8 and metal workpiece 6 and a direct current or a current obtained by superimposing an alternating current on a direct current is passed from a current source 9 in the direction of from the metal workpiece 6 to the electrode 8 through the jet of electrolyte. Consequently the metal workpiece 6 is electrolytically etched with a perforated portion 12 being formed as shown in FIG. 4. As shown in FIG. 5, the stencil 1 is removed from the metal workpiece 6 and is placed into intimate contact with a second metal workpiece 6 as shown in FIG. 3, and then the above mentioned steps are again repeated with one stencil, thereby facilitating the etching of many metal workpieces 6.

The used electrolyte accumulated in an electrolyte reservoir (not illustrated) located below the supporting base is sent to an electrolyte storage tank and eventually is used again as an electrolyte. The electrolyte can be filtered before reuse if desired or necessary.

By the way, the ingredient of the metal workpiece may be stored as dissolved-out ions in the repeatedly used electrolyte. When such dissolved-out ions increase to a certain concentration, the electrolytic etching effect may reduce. In such case, when he concentration of the dissolved-out ions reaches said concentration, the electrolyte will be discarded and replaced with a new solution or, while the electrolyte is being used, said metal ions can be electrically deposited on a proper cathode plate in such ion electrically depositing device provided in the electrolyte circulating system and will be removed to increase the life of the electrolyte.

The etching tolerance of the electrolytic etching method of the present invention is not lower than in the conventional case of etching by using a resist. Thus an etched workpiece of close tolerance can be made by the method of the present invention.

Thus, an etching of close tolerance can be made by merely pressing the stencil 1 into intimate contact with the metal workpiece 6, and an etching speed far higher than in the conventional etching method can be obtained with a much better overall effect when compared to known electrolytic etching methods.

Figure 6:
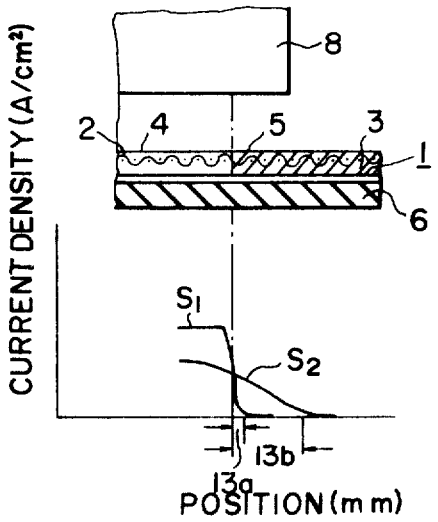
FIG. 6 is a graph showing an electric current distribution on the metal workpiece surface when an electrolytic etching action is taking place.

The reason of this is presumed to be that, as shown in FIG. 6, the non-etched part of the metal workpiece 6 is covered with the electric insulating stencil 1, therefore, in the case of electrolytic etching by using a jet of electrolyte, the distribution of the electric current flowing in the electrolytic etching will be defined by a curve $S_1$ in FIG. 6, in which the air gap between the electric insulating stencil 1 and the metal workpiece 6 is narrow. In this case, undesirably etched area or so-called side etch area 13 a will be small that the electric current entering the air gap between them will be substantially negligible and, therefore, if the electrolyte comes in between them, no etching action will occur.

By way of comparison, in the static electrolytic etching method carried out by dipping a metal workpiece and the electrode in the electrolyte, the current distribution will be as shown in a curve $S_2$, the side etch area 13*b* becoming wider with the effect that the etching result produced by using a jet of electrolyte can not be obtained.

In the chemical milling method by using a masking plate, the etching solution to be used for etching has a property of essentially etching the metal workpiece and, therefore, if any etching solution exists between the masking plate and metal workpiece, an etching action will naturally take place to etch the surface of the metal workpiece. On the other hand, the electrolyte has no etching action in itself but will show an etching action only when an electric current is interposed. Therefore, if only the electric current is shielded, the interposition of some electrolyte will create no trouble.

The etching speed in the chemical milling method depends on only the chemical interaction of the metal workpiece and etching solution and therefore, in the case of using a fixed etching solution, the latitude in the fluctuation of the etching velocity is very small. But, in the case of the electrolytic etching method, there is such a large latitude because of the use of an electric current which makes it easy to produce a practically higher etching velocity.

According to the method of the present invention, as in the case of a stamping method, the steps of forming and removing the resist of a respective metal workpiece can be omitted, and therefore, generally an electrolytically etched product having a close tolerance can be made in five steps: (1) placing the stencil into intimate contact with the metal. (2) electrolytic etching, (3) removal of the stencil, (4) water washing and (5) drying. Furthermore, the continuous working is easy, the etching velocity is higher than in the ordinary etching method and it is possible to incorporate a mechanism of easily adjusting the etched state.

The stencil that can be used in the method of the present invention is as follows:

1. a stencil made by forming an electric insulating emulsion pattern by painting an electric insulating screen with an emulsion (for example, a photosensitive resist) and then placing a master plate onto the painted screen. exposing it through the master plate and thereafter developing the film of the emulsion;

2. a stencil made by painting a base film with an emulsion in advance, placing a master plate onto the painted screen, exposing through the master plate and developing the film of emulsion to form an electric insulating emulsion pattern and then transferring the emulsion pattern to an electric insulating screen;

3. a stencil made by forming an electric insulating paste pattern by hand-writing or screen-printing method on an electric insulating screen;

4. a stencil made by opening an electric insulating film and bonding said film on an electric insulating screen;

5. a stencil made by painting a base film with an electric insulating emulsion rather thick in advance, placing a master plate onto the painted base film, exposing through the master plate, developing the film of the emulsion and then peeling the original plate off the base film; or 6. a stencil made by opening an electric insulating film. A stencil having a screen is preferable as a pattern of close tolerance can be formed, and also a pattern having a portion isolated in the form of an island can be formed.

In the case where the stencil has an electric insulating screen, though the meshes of the screen provide an open portion in the stencil, if an air gap exists between the screen and the surface of the metal workpiece to be etched upon the introduction of the electric current there will be produced substantially no influence of the projection of the meshes and thus the presence of the meshes of the screen will not create a problem.

The screen material to be used for the stencil to be used in the method of the present invention can be a commercial product made of nylon or Tetoron Yarns. For the electrolytic shielding resist, it is preferable to use such solvent-soluble photoresist as a polyvinyl cinnamate typed resist, for example, KPR(Kodak Photoresist), a cyclic rubber type resist KMER (Kodak Metal Etching Resist composed mostly of cis-polyisoprene) or an orthoquinone diazide series resist, for example, AZ 111 (produced by Shiply Co., U.S.A.) because it can be photochemically easily produced and is high in electrolyte-proofness. The water-soluble resist for screen-printing plates for example, a polyvinyl alcohol-dichromate type screen-printing plate, is low in the electrolyte-proofness and is not preferable.

Stainless steel or copper meshes can be used for said screen. In this case, any particular electrode need not be used and the screen meshes themselves become an electrode. However, there are so many problems to be technically solved, such as, the screen wires are generaly too thin to pass a large electric current, that, as the thickness of the resist is limited, the distance between the electrodes is so small as to be short-circuited occasionally, that the entire surface of the screen must be always kept in intimate contact with the plate to work and the electrolyte must be uniformly jetted over the entire surface to be machined.

The electric insulating film to be used for the stencil to be used in the present invention can be a resin film having an electrically insulating property and an electrolytic etching solution-proofness such as, for example polyvinyl chloride, a polyester, a polyimide, an acrylate resin, Nylon, polypropylene, polyethylene or a silicone resin.

Further, the electric insulating paste to be used can be a resin as a polyvinyl acetate, a polyester resin, a silicone resin or polyethylene.

In performing the method of the present invention, the direction of the jet of electrolyte is diagonal to the surface of the metal workpiece 6 in FIGS. 3 and 4 but it is preferable that the direction of the jet of electrolyte is disposed vertical to the surface to be worked.

Figure 7:
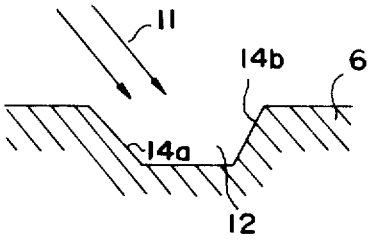
FIG. 7 is a enlarged sectional view of an etched part when the metal workpiece is etched by jetting the electrolyte diagonally to the metal working piece.
Figure 8:
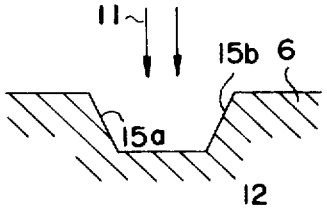
FIG. 8 is an enlarged sectional view of an etched part when the metal workpiece is etched by jetting the electrolyte vertically to the metal workpiece.

The reason for this is that, in case the electrolyte 11 is dashed against the metal workpiece 6 in the diagonal direction, the end surfaces 14a and 14b of the etched part will become asymmetrical with respect to each other as shown in FIG. 7. On the other hand, when the metal workpiece 6 is electrolytically etched with a vertical jet flow, symmetrical end surfaces 15a and 15b of the etched portion will be obtained as shown in FIG. 8, and therefore in case a machining of close tolerance is required, it will be desirable to electrolytically etch the metal workpiece with a vertical jet flow.

Figure 9:
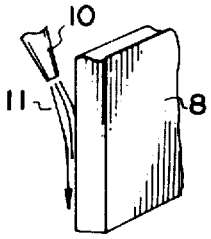
FIGS. 9 to 11 are perspective views showing position relations of the electrode and electrolyte jetting nozzle.

FIGS. 9 to 12 represent positions of the electrode and jetting nozzle of electrolyte in the case of electrolytic etching using a jet of electrolyte 11. In FIG. 9, the electrolyte 11 jetted from a nozzle 10 whose jet is directed toward the surface of the electrode 8 is dashed diagonally to the plate surface, and will then flow down along the plate surface and will be dashed vertically to the metal workpiece (not illustrated).

Figure 10:
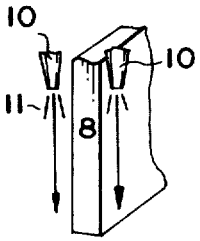

In FIG. 10, the electrolyte 11 is jetted vertically with respect to the metal workpiece (not illustrated) out of a pair of electrolyte jetting nozzles 10 arranged so that the direction of the jet flow may be vertical to the metal workpiece (not illustrated) on both sides of the electrode plate 8 and is dashed vertically to the metal workpiece (not illustrated).

Figure 11:
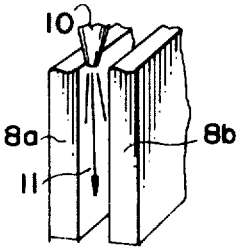

In FIG. 11, two elect rode plates 8a and 8b are arranged in parallel with respect to each other at a proper spacing, and the electrolyte jetting nozzle 10 is arranged so that the direction of the jet flow may be vertical to the metal workpiece (not illustrated) between both electrode plates 8a and 8b. The electrolyte 11 is jetted vertically to the metal workpiece (not illustrated) and is dashed vertically to the metal workpiece (not illustrated).

Figure 12:
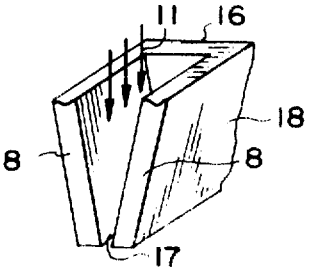
FIG. 12 is a perspective view of an electrolyte jetting electrode made by opposing two electrode plates in the form of a V, connecting them with each other at both ends and forming a slit in the lower part.

Further, in FIG. 12, an electrolyte jetting electrode 18 is defined by two opposing electrode plates 8 which oppose each other in the form of V. Both electrode plates 8 are connected with each other at both ends, forming a slit in the lower part thereof, and the electrolyte 11 is jetted through the slit 17 and is dashed vertically to the metal workpiece (not illustrated).

In the case of electrolytic etching by jetting the electrolyte according to the method of the present invention, the distance between the electrode can be made very small and can be freely selected to be from several 10 microns to several mm. If the distance between the electrodes is small, the directivity of the electrolysis will be produced, the electrolytic etching velocity will be a maximum where the distance is minimum and a remarkable electrolytic etching velocity difference will be produced by this distance difference. Therefore, the electrolyzing section will be substantially only in the vicinity of the electrode. As the stencil may exist essentially only on the metal workpiece in the vicinity of the electrode, efforts may be made to bring only the stencil in the vicinity of the electrode perfectly into intimate contact with the metal workpiece.

Figure 13:
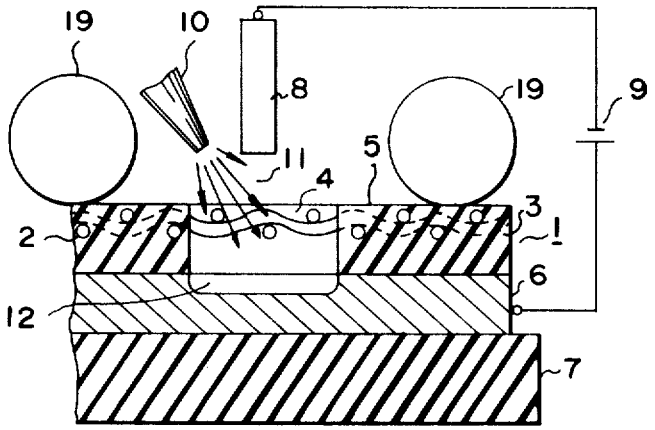
FIG. 13 is an enlarged sectional view of an electrolytically etching apparatus provided with pressing rolls.
Figure 14:
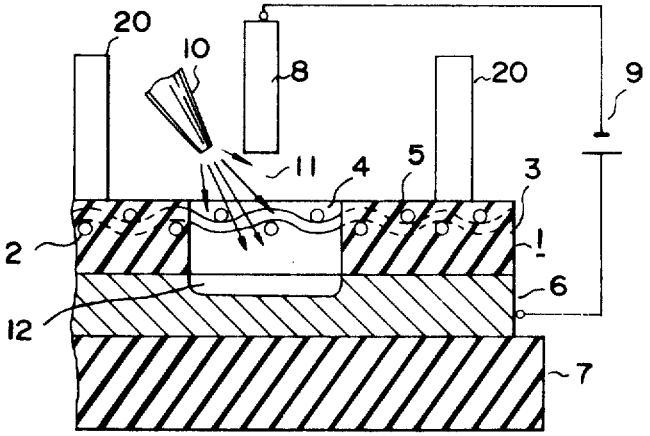
FIG. 14 is a enlarged sectional view of an electrolytic etching apparatus provided with pressing plates.

FIGS. 13 and 14 represent an electrolytic etching being made by locally elevating the intimate contact by intimate contact assisting means. In FIG. 13, in order to make the intimate contact between the stencil 1 and metal workpiece more perfect, pressing rolls 19 are provided in a part separated from the electrode 8 by several mm. to several 10 mm. as intimate contact assisting means. In FIG. 14, pressing plates 20 are provided as intimate contact assisting means.

If such intimate contact assisting means as are shown in FIGS. 13 and 14 are provided, the liquid flow will be shielded by said means and therefore it will not be necessary to consider very much the intimate contact outside thereof.

Therefore, even in the case of machining a large area, it will not be necessary to widen the area of the electrode 8.

In the case of electrolytic etching by using the above mentioned pressing rolls 19 or pressing plates 20, the flow of the electrolyte 11 will be interrupted by the pressing rolls 19 or pressing plates 20, and the electrolyte 11 will be discharged only in the two opened forward and rearward direction. Therefore, the electrolyte 11 will gradually accumulate in the etched part due to the difference between the jetting velocity and discharging velocity of the electrolyte and, when the accumulated solution becomes deep, the replacement of the electrolyte from old to new will become low, the jetting effect will be decreased, and the amount of the electric current will decrease and the electrolytic etching velocity will be reduced.

Figure 15:
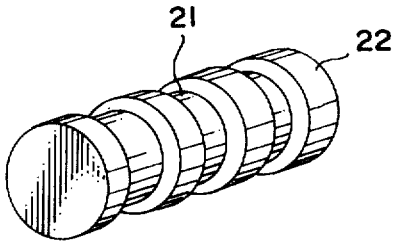
FIG. 15 is a perspective view of the pressing roll used in FIG. 13 and provided with a plurality of grooves made on the peripheral surface.
Figure 16:
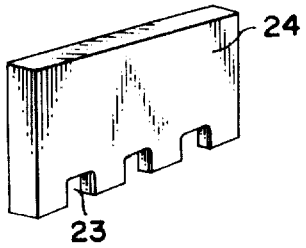
FIG. 16 is a perspective view of the pressing plate used in FIG. 13 and having a plurality of notches.

FIGS. 15 and 16, show the elimination of the above mentioned troubles. FIG. 15 shows a pressing roll 22 having a plurality of grooves 21 made as discharging parts for the electrolyte. FIG. 16 shows a pressing plate 24 having many notches 23 opened in the lower portion thereof. In this manner, holes (not illustrated) may be opened instead of notches 23.

Figure 17:
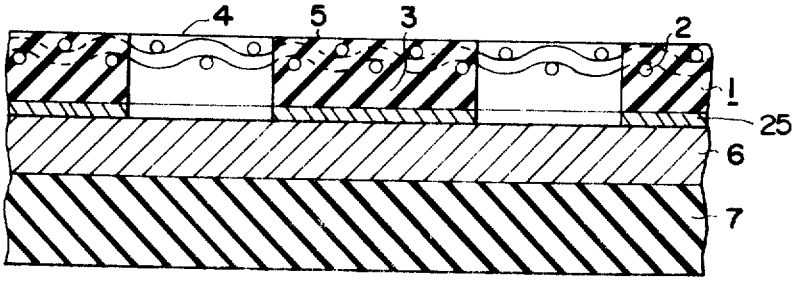
FIG. 17 is a enlarged sectional view of a stencil as brought into perfectly intimate contact with a metal workpiece with a binder.

FIG. 17 shows a means for providing the intimate contact between the stencil 1 and metal workpiece 6 more perfect wherein a binder layer 25 is provided on the surface on the side in contact with the metal workpiece 6 of the resist surface of the stencil 1. The binder layer 25 is preferably a pressure-sensitive type binder. That is to say, when the stencil 1 and metal workpiece 6 are placed into contact with each other and are then properly pressed (with rollers or the like), they will be perfectly pressure-sensitively bonded with each other by the binder layer 25 and will be in perfect intimate contact with each other without leaving any air gaps between them. After the completion of the etching, the stencil 1 is removed and is repeatedly used for the etching of metal workpiece. In case the binder layer deteriorates, the old binder layer may be removed with a proper solvent and a new binder layer may be painted thereon. The binder can be simply applied by stretching a binder paste uniformly on a hard roller made of a metal, hard rubber or plastic and rolling the roller on the resist pattern surface of the stencil so that the binder is transfered onto the resist pattern. As the roller is hard, the binder will be prevented from being deposited in the opening portion but will be deposited only on the resist pattern surface.

Figure 18:
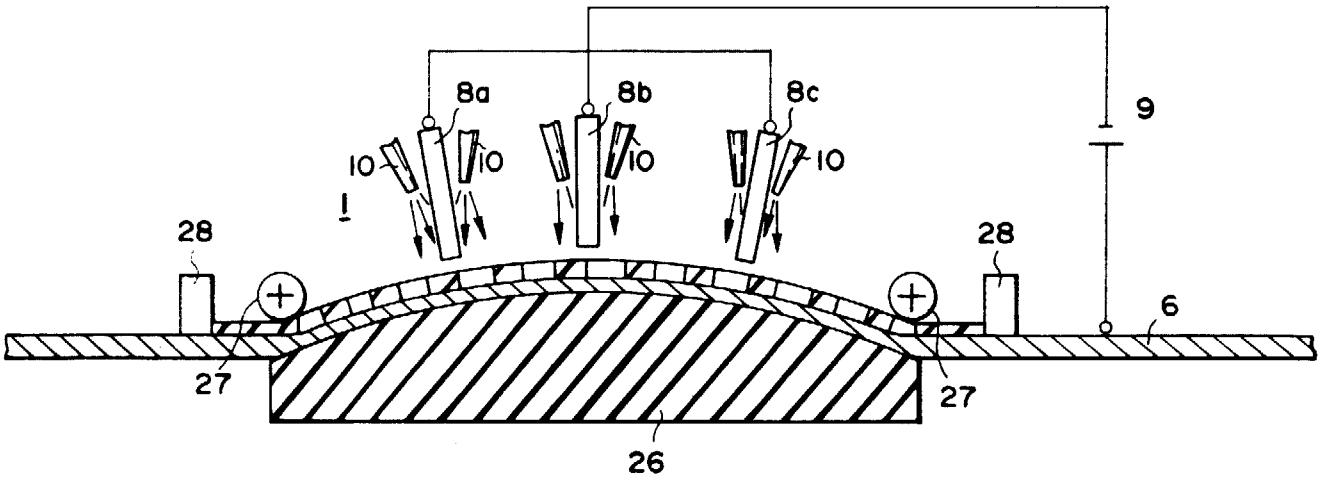
FIG. 18 is an enlarged sectional view of an electrolytic etching apparatus provided with a supporting base having a convex surface and pressing rolls.

FIG. 18 represents an electrolytic etching method wherein the stencil 1 and metal workpiece 6 under a proper tension are pressed onto a convex surface of a supporting base 26 having a convex surface so as to be in intimate contact with each other.

The flexible metal workpiece 6 and stencil 1 subjected to a proper tension are pressed onto the convex surface of the supporting base 26 by pressing rolls 27 so as to be in intimate contact with each other.

The stencil 1 under a proper tension is fixed by a supporting frame 28.

The surface of the supporting base 26 is formed of an electric insulating material and is generally preferably of an arcuate form or the like. It is also preferable to determine its curvature by considering such factors as the conditions as the material, thickness and width of the metal workpiece.

If the stencil has a sufficient thickness (several 10 microns to 1 mm.) and the electrode is slowly moved while being pressed along the stencil surface and thus is squeezed in the case of screen-printing, the entire surface will be able to be worked. That is to say, the electrode can be made to serve as a pressing plate. Further, if a plurality of electrodes are arranged in parallel, the etching velocity will naturally be inreased several times.

Figure 19:
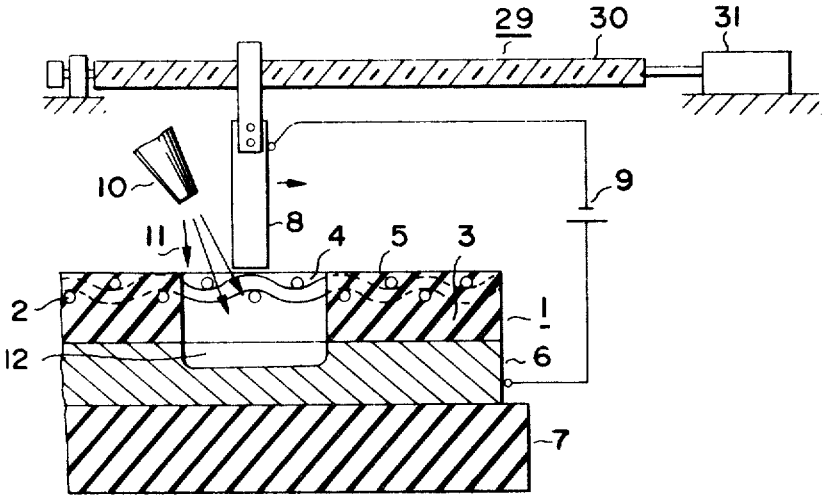
FIG. 19 is a enlarged sectional view of an electrolytic etching apparatus provided with an electrode conveying mechanism.

FIG. 19 represents an etching apparatus wherein the electrode 8 is moved while in contact with the surface of the stencil 1 and thus is squeezed as in the case of screen-printing. The electrode 8 is moved at any desired velocity by a conveying mechanism 29. By the way, in the drawing, numeral 30 signifies a feeding screw and numeral 31 signifies a driving motor.

Figure 20:
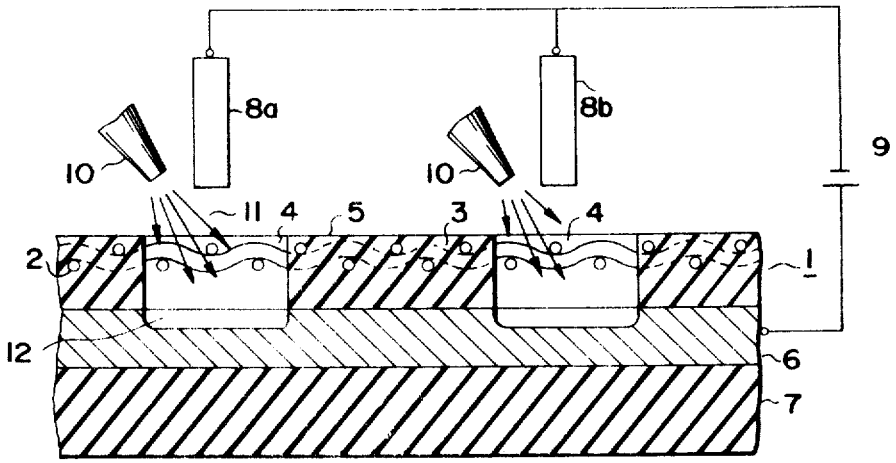
FIG. 20 is an enlarged sectional view of an electrolytic etching apparatus provided with a plurality of electrodes.

FIG. 20 represents an apparatus provided with a plurality of electrodes *8a, 8b,* - - -.

The electric current to be used in the case of electrolytic etching is different depending on the situation but can be several amperes to several 10 amperes/cm$^2$.

The electrolytic etching method according to the present invention can be effectively applied to the production of such products as special electron tube electrodes, type wheels (printing rings) for electronic computers, various kinds of lead wires, various kinds of electronic parts, metallic filters for centrifuges, juicers and others, shadow masks for color televisions, outer blades of electric shavers, gears for watches, parts for cameras, metal masks for screen-printing, metal targets, optical slits, film vapor-deposited plates, name plates, eteched decorative articles, printed circuit plates, partially electrolytic grinding products and partially anodic oxidizing products.

The present invention shall be concretely explained with the following examples which are considered to be merely representative of the present invention and thus should not be considered as limiting.

EXAMPLE 1

A silk screen of 150 wires/inch was painted with KMER on the surface, a pattern was then printed on it and the film of KMER was developed. The thickness of the resist pattern was 50 microns. This stencil was placed into intimate contact with a copper plate having a thickness of 0.20 mm. and an area of 100 × 100 mm., arranged on a supporter made of bakelite. A copper electrode was arranged at a distance of 1 mm. from the stencil. An electrolyte (15% $KNO_3$) was jetted vertically onto the stencil near the electrode under a pressure of 3 kg./cm$^2$. through a nozzle. An electric current of about 30A./cm$^2$. was passed for about 40 seconds to electrolytically etch the copper plate.

When the etching was completed, perforated holes were formed through the copper plate with the tolerance of ±0.2 mm. When etching was then carried out by repeatedly utilizing the above mentioned stencil, about 1000 copper plate could be etched.

EXAMPLE 2

Etching was carried out under the same condition as in Example 1 but by pressing the stencil and metal with a pressing roll to increase the intimate contact with each other. The etched shape of the copper plate was sharper than in Example 1 and the etching tolerance was improved to be ±0.05 to 0.1 mm.

EXAMPLE 3

Etching was carried out in the below mentioned manner by using the stencil in Example 1. The stencil was placed into intimate contact with an iron plate of a thickness of 0.15 mm. and an area of 200 × 200 mm. arranged on a supporter made of bakelite. On the other hand, a copper plate was formed to be squeezed as an electrode. An electrolyte (15% NaCl) was jetted vertically onto the stencil near the electrode under a pressure of 2.5 kg./cm$^2$. through a nozzle. The electrode was slowly moved while in contact with the stencil surface. An electric current of about 40A./cm$^2$. was passed for 60 seconds so that electrolytic etching was carried out.

When the etching was completed, perforated holes were formed through the iron plate at an electrolytic etching tolerance of ±0.15 mm.

EXAMPLE 4

Etching was carried out under the same conditions as in Example 1 but by placing the stencil into intimate contact with the copper plate after a binder (polyvinyl acetate resin) was coated on that surface of the stencil on the side of intimate contact with the copper plate to perfect the intimate contact with each other.

As a result, the etched shape of the copper plate was sharper than in Example 1 and the etching tolerance was improved to be ±0.05 mm.

EXAMPLE 5

Etching was carried out under the same conditions as in Example 4 except by replacing the binder (polyvinyl acetate resin) with a concentrated polyvinyl alcohol solution. During the etching, the polyvinyl alcohol gelled with the electrolyte ($KNO_3$ solution) and prevented the solution from penetrating between the layers. Thus the same effect as in Example 4 was obtained.

EXAMPLE 6

Examples 1 to 5 were repeated by using the below mentioned five kinds of stencils instead of the stencil in Example 1. As a result, the same effects as in Examples 1 to 5 were obtained.

Stencil (a):

A stencil formed by painting a polyester of a thickness of 0.2 mm. with KMER on the surface, printing a pattern on it and developing the film of KMER to form a resist pattern and then etching the resist pattern with a solution prepared by adding some amount of carbolic acid to concentrated sulfuric acid.

Stencil (b):

A stenci made by forming an etched pattern by the same method as of making the stencil (a) and then bonding said etched pattern and a silk screen of 150 wires/inch with each other by using a binder (non-solvent type epoxy series binder).

Stencil (c):

A stencil formed by painting a polyimide of a thickness of 0.1 mm. with KMER on the surface, then printing a pattern on it and developing the film of KMER to form a resist pattern and then etching the resist pattern with a solution of 20% caustic soda.

Stencil (d):

A stencil made by forming an etched pattern by the same method as of making the stencil (c) and then bonding said etched pattern and silk screen of 150 wires/inch by using a binder (non-solvent type epoxy series binder).

Stencil (e):

A stencil made of an etched plate of tantalum or titanium by making a resist pattern of KMER on a tantalum plate or titanium plate, etching the plate with fluoric acid, then removing the resist, then anodically oxidizing the entire surface of the plate with the anodic oxidizing bath by making said etched plate an anode and using a lead plate as a cathode to coat said surface with an electrically insulating anodically oxidized film.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What I claim is:

1. A method for the electrolytic etching of a metal workpiece comprising placing a stencil made of an electric insulating material containing a pattern having open portions and closed portions into intimate contact with the metal workpiece, placing an electrode adjacent to said metal workpiece, maintaining a distance of from several 10 microns to several mm between said electrodes and said metal workpiece, and jetting an electrolyte between said electrode and said metal workpiece while passing an electric current through the jet of electrolyte in the direction from said metal workpiece to said electrode to electrolytically etch said metal workpiece, and then separating said stencil from the electrolytically etched metal workpiece.

2. A method as claimed in claim 1 wherein said pattern having open and closed portions is a screen made of an electric insulating material and wherein said stencil to be used is made by filling the meshes of the screen of that portion corresponding to the non-etched portion of the metal workpiece with an electric insulating resist.

3. A method as claimed in claim 1 wherein said pattern having open and closed portions is a screen made of an electric insulating material and wherein said stencil to be used is made by filling the meshes of the screen of that portion corresponding to the non-etched portion of the metal workpiece with a paste of an electric insulating material.

4. A method as claimed in claim 1 wherein said stencil to be used is made by bonding a film made of an electric insulating material, and forming a pattern consisting of open and closed portions on a screen made of an electric insulating material.

5. A method as claimed in claim 1 wherein said stencil to be used is made of an electric insulating material formed as a pattern consisting of an open portion and a closed portion.

6. A method as claimed in claim 1 wherein the flow of the electrolyte is jetted perpendiculary to the metal workpiece to electrolytically etch the surface thereof.

7. A method as claimed in claim 1 wherein said metal workpiece and stencil are pres ed locally into intimate contact with each other by pressing means.

8. A method as claimed in claim 7 wherein said pressing means are pressing rolls.

9. A method as claimed in claim 8 wherein said pressing rolls are provided with means for discharging the electrolyte.

10. A method as claimed in claim 7 wherein said pressing means are pressing plates.

11. A method as claimed in claim 10 wherein said pressing plates are provided with means for discharging the electrolyte.

12. A method as claimed in claim 1 wherein said metal workpiece and stencil are bonded to each other with a pressure-sensitive binder.

13. A method as claimed in claim 1 wherein said electrode to be used is a plate-shaped eletrode and said metal and stencil are locally pressed with said plate-shaped electrode so that said metal may be locally, electrolytically etched.

14. A method as claimed in claim 1 wherein said electrode to be used is a plate-shaped electrode, said metal workpiece and stencil are locally pressed with said plate-shaped electrode so that said metal workpiece may be locally electrolytically etched, then said plate-shaped electrode is moved to locally press said metal workpiece and stencil together in other locations so that said metal workpiece may be electrolytically etched and then said plate-shaped electrode is moved in turn so that the unmachined parts of said metal workpiece may be electrolytically etched, in turn.

15. A method as claimed in claim 1 wherein said metal workpiece and stencil are mounted on a supporting base having a convex surface and are pressed onto the convex surface of said supporting base by said pressing means so as to be in intimate contact therewith.

16. The method of claim 1 wherein the separated stencil is again placed into intimate contact with a subsequent metal workpiece and the procedure is repeated a plurality of times.

* * * * *